US005346197A

United States Patent [19]

Takano et al.

[11] Patent Number: 5,346,197

[45] Date of Patent: Sep. 13, 1994

[54] MANUAL RECORDING PAPER INSERTION MECHANISM

[75] Inventors: Masatoshi Takano, Akikawa; Satoshi Hokamura, Niza, both of Japan

[73] Assignee: Asahi Kogaku Kogyo Kabushiki Kaisha, Tokyo, Japan

[21] Appl. No.: 132,214

[22] Filed: Oct. 6, 1993

Related U.S. Application Data

[63] Continuation of Ser. No. 909,020, Jul. 6, 1992, abandoned.

[30] Foreign Application Priority Data

Jul. 5, 1991 [JP] Japan ..... 3-261484

[51] Int. Cl.[5] ..... B65H 3/44

[52] U.S. Cl. ..... 271/9; 271/127; 271/162; 271/171

[58] Field of Search ..... 271/9, 157, 162, 127, 271/171

[56] References Cited

U.S. PATENT DOCUMENTS

| | | | |
|---|---|---|---|
| 4,285,510 | 8/1981 | Kanno et al. | 271/9 X |
| 4,429,863 | 2/1984 | Itoh et al. | 271/9 |
| 4,772,007 | 9/1988 | Kashimura | 271/157 X |
| 4,791,457 | 12/1988 | Shida | 271/9 X |
| 4,991,830 | 2/1991 | Yamanaka | 271/9 |
| 5,088,715 | 2/1992 | Shibata et al. | 271/9 |
| 5,145,160 | 9/1992 | Nagashima et al. | 271/9 |

FOREIGN PATENT DOCUMENTS

| | | | |
|---|---|---|---|
| 9646 | 1/1982 | Japan | 271/9 |
| 55031 | 3/1986 | Japan | 271/157 |
| 124450 | 6/1986 | Japan | 271/9 |
| 12530 | 1/1987 | Japan | 271/157 |
| 204229 | 8/1990 | Japan | 271/9 |

*Primary Examiner*—Robert P. Olszewski
*Assistant Examiner*—Boris Milef
*Attorney, Agent, or Firm*—Sandler Greenblum & Bernstein

[57] ABSTRACT

A paper feed mechanism is provided for individually supplying recording papers to an imaging apparatus. A plurality of papers are stacked on a tray member of a paper cassette. One end of the tray member is biased toward a feeding roller and presses the stacked papers toward the feeding roller. The papers are fed one by one upon rotation of the feeding roller. A swingable guide member is mounted on the paper cassette to cover the stacked papers. By swinging the guide member, the stacked papers, as well as the tray member, are downwardly moved away from the feeding roller, so that a spacing is formed between the feeding roller and the stacked papers. One or more other recording papers can be inserted into the spacing, to be fed by the feeding roller instead of the stacked papers.

23 Claims, 5 Drawing Sheets

MANUAL RECORDING PAPER INSERTION MECHANISM

This application is a continuation of application No. 07/909,020, filed Jul. 6, 1992, now abandoned.

BACKGROUND OF THE INVENTION

The present invention relates to a manual recording paper insertion mechanism for an imaging apparatus. A recording paper is usually supplied such on imaging apparatus. A from a recording paper cassette detachably mounted to a paper supply unit, and other recording paper, different from that accommodated in the recording paper cassette, can be supplied without removing the recording paper cassette.

Some imaging apparatuses, such as copy machines, printers, facsimiles, and the like, form an image on a piece of plain paper cut to a predetermined size. This kind of the imaging apparatus generally has a recording paper cassette for accommodating plain (blank) papers as recording papers. The cassette is detachably mounted to a paper supply unit, and images are formed on recording paper sheets fed one by one from the recording paper cassette.

Since recording papers (sheets) have various sizes, the imaging apparatus can be mounted with a plurality of recording paper cassettes, each accommodating recording papers of different size, to cope with a plurality of recording paper sizes, which can be in particular indispensable to a copy machine.

In this connection, the imaging apparatus (to which a recording paper is supplied from the recording paper cassette as described above) is generally configured with a recording paper cassette for accommodating recording papers used more frequently (size or paper quality) mounted thereto. When an image is to be formed on a recording paper different from the frequently used recording paper, a recording paper cassette accommodating the different recording paper is positioned in the place of the frequently used recording paper cassette (in the case of an imaging apparatus to which a plurality of recording paper cassettes can be mounted, the above recording paper cassette is switched to a recording paper cassette to be used). In the meantime, there is rarely a case that an image must be formed on a recording paper which is not generally used, and to cope with such a case, the imaging apparatus is provided with a so-called manual insertion mechanism to enable a recording paper to be directly supplied to the apparatus without being accomodated in a recording paper cassette so that a time-consuming job of accommodating the recording paper in a recording paper cassette and mounting the cassette to the apparatus can be avoided.

However, a conventional manual insertion mechanism has a complex structure and requires an imaging apparatus of increased size because the mechanism has been arranged on the apparatus side. In addition it is time-consuming to manually insert a plurality of recording papers, because such a conventional mechanism is arranged to insert recording papers one by one.

SUMMARY OF THE INVENTION

It is therefore an object of the present invention to provide a paper feed mechanism for an imaging device of decreased complexity, capable of enabling a plurality of recording papers to be inserted providing a complex insertion mechanism with an imaging invention, a paper feed mechanism is provided which comprises:

- a tray member for placing thereon a plurality of papers in a stacked state;
- a feed member disposed above one end of the tray member for feeding the stacked papers one by one;
- a lift member disposed below the one end of the tray member for urging the one end toward the feed member, the stacked papers being thereby pressed against the feed member; and
- a guide member disposed above the tray member with one end thereof adjacent to the feed member, the one end of the guide member being swingable toward the one end of the tray member.

The one end of the tray member is swung away from the feed member when the one end of the guide member is swung toward the one end of the tray member, so that a spacing is created between the feed member and the stacked papers, which allows other papers to be placed in the spacing and to be fed by the feed member.

According to this arrangement, a plurality of recording papers can be manually inserted without providing a complex mechanism.

DESCRIPTION OF THE ACCOMPANYING DRAWINGS

DESCRIPTION OF THE PREFERRED EMBODIMENTS

An embodiment of the present invention will be described below with reference to the attached drawings.

Figure 1:
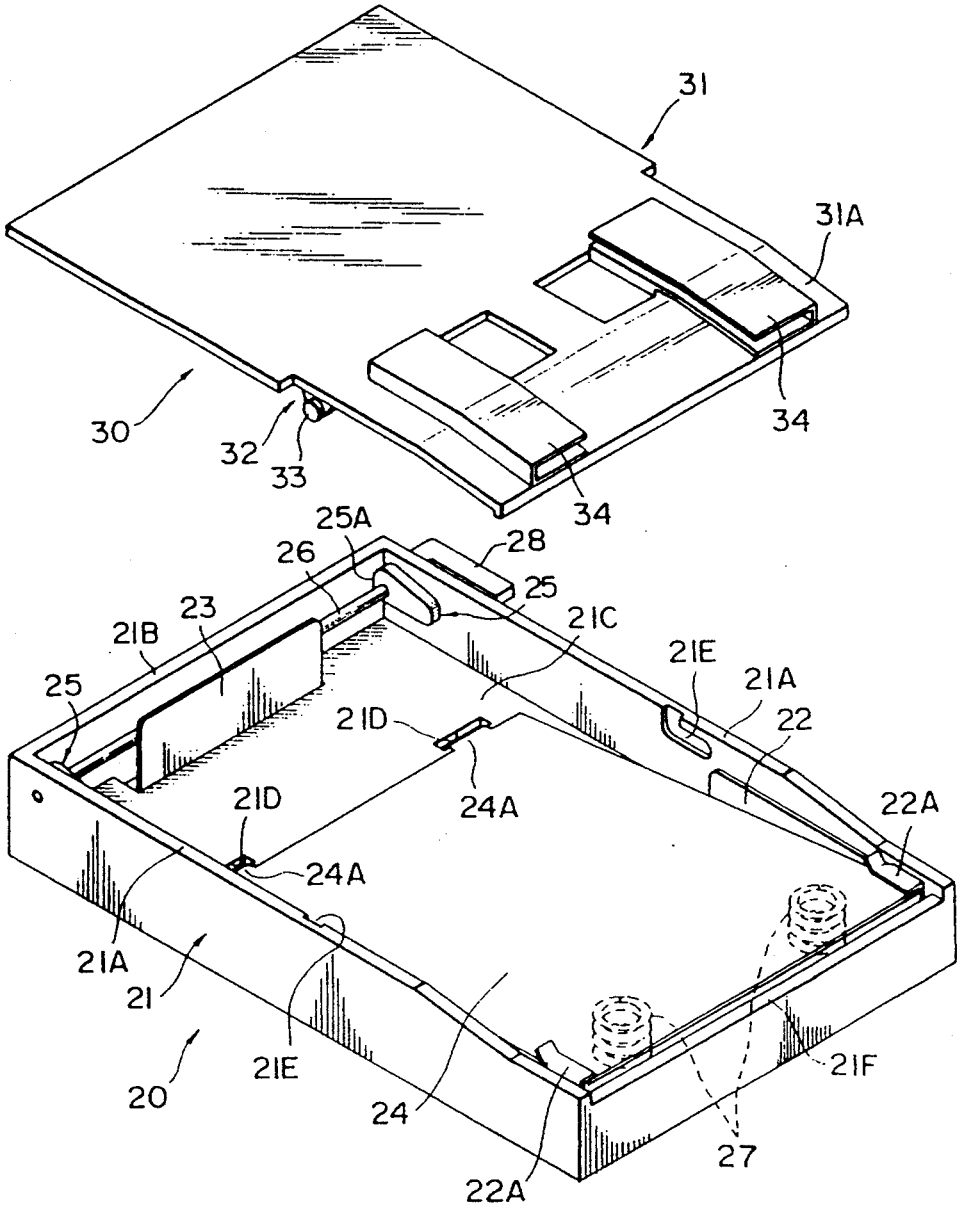
FIG. 1 is an exploded perspective view of a recording paper cassette to which an embodiment of a manual recording paper insertion mechanism is applied.
Figure 2:
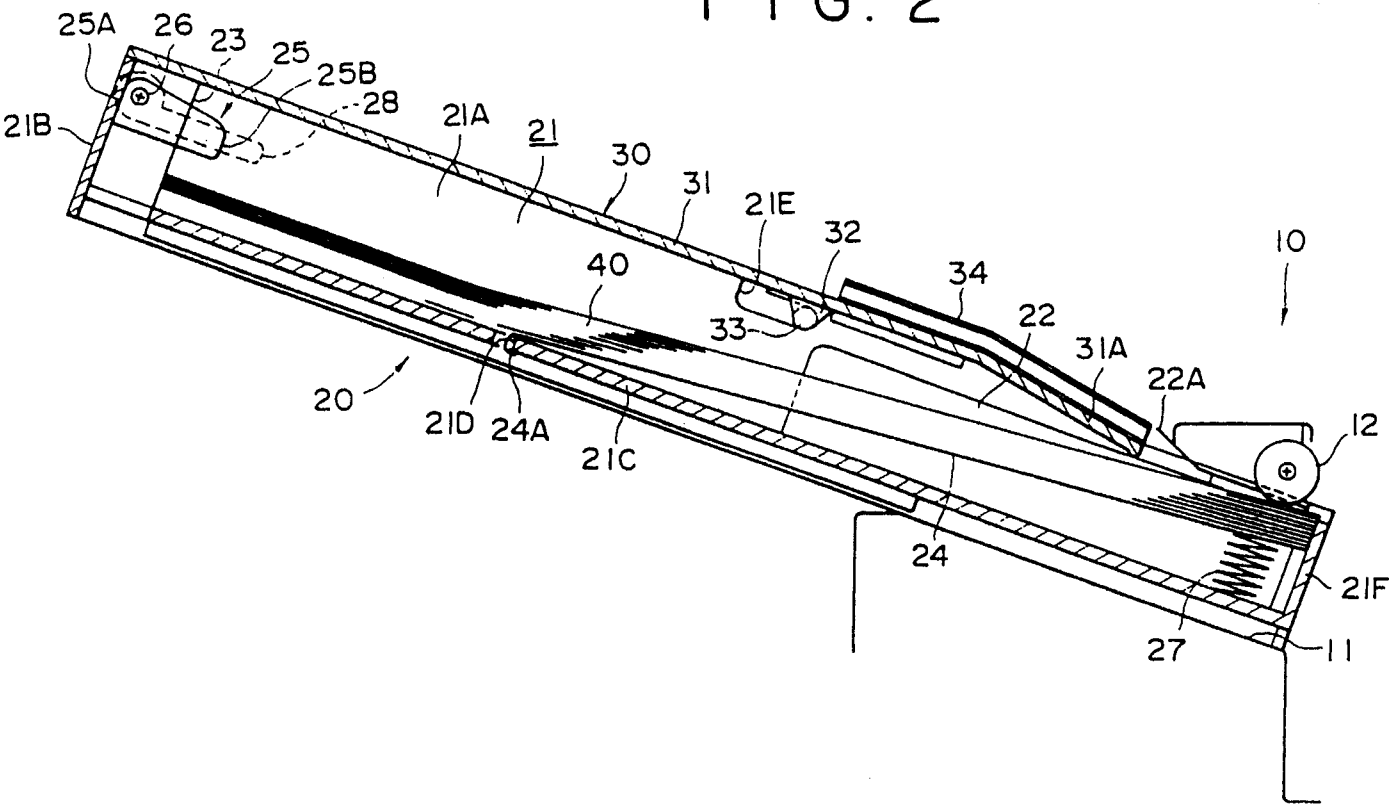
FIG. 2 is a longitudinal cross sectional view of the recording paper cassette mounted to an imaging apparatus.

FIG. 1 is an exploded perspective view of a recording paper cassette 20 which corresponds to an embodiment of a manual recording paper insertion mechanism according to the present invention. FIG. 2 is a longitudinal cross sectional view of the recording paper cassette 20 mounted to a paper supply unit 10 of an imaging apparatus. Note that the recording paper cassette 20 shown in FIG. 1 does not accommodate recording papers.

The paper supply unit 10 of the imaging apparatus shown in FIG. 2 has a cassette inserting portion 11 which enables the front end of the recording paper cassette 20 to be inserted into the imaging apparatus by a predetermined amount. The recording paper cassette 20 is mounted at a predetermined position.

The cassette inserting portion 11 includes a recording paper introduction roller 12 located at a position corresponding to the upper front end of recording papers 40 accommodated in the recording paper cassette 20 inserted into the cassette inserting portion 11 as shown in FIG. 2. The recording paper introduction roller 12 is disposed at the center in the width direction of the recording paper cassette 20, and the longitudinal direction thereof coincides with the width direction of the recording paper cassette 20. The recording paper introduction roller 12 has a length sufficiently shorter than a distance between the confronting edges of a recording paper upper surface press unit 22A of the recording paper cassette 20. The roller 12 is disposed such that when the recording paper cassette 20 is mounted, a portion of the circumference of the recording paper introduction roller 12 is located below the lower surface of the recording paper upper surface press unit 22A (on the bottom portion 21C side of a vessel 21). Further, the recording paper introduction roller 12 is rotated by a rotating force transmitted from a drive source (not shown) provided with the apparatus, and thus the recording papers 40 accommodated in the recording paper cassette 20 are sequentially introduced into the apparatus (to the right side in FIG. 2) from the uppermost one thereof.

The recording paper cassette 20 is composed of an upwardly-opened rectangular parallelepiped vessel 21 having a rectangular plane surface and a shallow depth, and includes side end regulation plates 22, 22 for regulating the side end positions of the accommodated recording papers 40 (only one of them is shown in FIG. 2) and a rear end regulation plate 23 for regulating the rear end thereof. The side end regulation plates 22, 22 are disposed on the front end side of the vessel 21 in parallel with the right and left side plates 21A, 21A of the vessel 21, and the rear end regulation plate 23 is disposed in parallel with the rear end plate 21B of the recording paper cassette 20 in the vicinity thereof. Further, a recording paper holding plate 24 is disposed at a position between the side end regulation plates 22, 22.

The side end regulation plate 22 is vertically disposed with a predetermined length in the forward and backward directions thereof and a predetermined height. The recording paper upper surface press unit 22A is bent toward the inside in the width direction of the vessel 21 at the front upper edge of the side end regulation plate 22. The rear side end of the recording paper upper surface press unit 22A is bent upward at a predetermined angle.

The rear end regulation pate 23 has a length shorter than the inside dimension in the width direction of the vessel 21 by a predetermined amount, and is centered with respect to the width direction of the vessel 21.

The recording paper holding plate 24 is engaged with the engagement holes 21D, 21D defined at the bottom portion 21C of the vessel 21 through a pair of right and left hooks 24A, 24A defined at the rear end thereof. The front end of the recording paper holding plate 24 can be swung upward and downward as the engaged portions serve as fulcrums. Further, the recording paper holding plate 24 is urged to force the front end thereof upward by the springs 27, 27 interposed between the front end of plate 24 and the bottom portion 21C of the vessel 21. As shown in FIG. 1, when the recording papers are not accommodated in the vessel 21, the position of the front end of the recording paper holding plate 24 is regulated in such a manner that the front end Is abutted against the lower surface of the recording paper upper surface press unit 22A of the side end regulation plates 22, 22.

An L-shaped support groove 21E is defined substantially centered between the forward and backward ends of the inner wall surface of each of the right and left side plates 21A, 21A of the vessel 21. Each L-shaped support groove 21E opens to the upper edge side of the side plate 21A and extends to the forward direction of the side plate 21A by a predetermined length at a predetermined height.

Levers 25, 25 function as operation means, and are disposed at the rear end of the vessel 21 in parallel with the rear end plate 21B. Levers 25,25 are supported by a shaft 26 which rotatably extends between the right and left side plates 21A, 21A, and are each located proximate to the right and left side plates 21A, 21A, and thus do not interfere with the rear end regulation plate 23.

Each of the levers 25 has a substantially rectangular shape, and is fixed to the shaft 26 which passes through one of the corner portions thereof. The corner of the lever 25 that is fixed to the shaft 26 is formed in an arcuate shape about the shaft 26. When the shaft 26 is rotated, an extreme end of the lever 25 is swung upward (in the counterclockwise direction in FIG. 2) but cannot be swung downward (clockwise) because the rear end surface 25A of the lever 25 is regulated by being abutted against the inner wall surface of the rear plate 21B of the vessel 21. When this rear end surface 25A is abutted against the inner surface of the rear plate 21B of the vessel 21, the lever 25 extends parallel to the bottom portion of the vessel 21, and is located below the upper edge of the vessel 21 (the upper edges of the side plates 21A, 21A and rear plate 21B). When the extreme end of lever 25 is swung upward by rotating shaft 26 (in the counterclockwise direction in FIG. 2) by 90°, the extreme end is projected beyond the upper edge of the vessel 21 by a predetermined amount.

Further, the shaft 26 projects outward from one of the side plates 21A, and an operation lever 28 is fixed to the projected portion. When the operation lever 28 is swung at a position outside of the vessel 21, the shaft 26 is rotated to thereby swing the lever 25.

With the vessel 21 arranged as described above, the recording papers 40 accommodated in the vessel 21 are supported by the recording paper holding plate 24. When the vessel 21 (the recording paper cassette 20) is not inserted into the cassette inserting portion 11 of the paper supply unit 10 of the imaging apparatus, the front end upper surface (at the right and left sides thereof) the of the recording papers 40 are abutted against the lower surface of the recording paper upper surface press unit 22A by the returning elastic force of the springs 27, 27. On the other hand, when the recording paper cassette 20 is inserted into the cassette inserting portion 11 of the paper supply unit 10 of the imaging apparatus as shown in FIG. 2, the front end upper surface of the recording papers 40 is urged toward the recording paper introduction roller 12 by the urging forces of the springs 27, 27. A portion of the circumference of the recording paper introduction roller 12 is located below the lower surface of the recording paper upper surface press unit 22A (on the bottom portion 21C side of the vessel 21).

A cover 30 is provided with a manual insertion function, and has a flat shape capable of substantially covering the upper opening of the vessel 21 (except the front end portion of the upper opening) interfering with the recording paper upper surface press unit 22A of the side end regulation plate 22. The front end portion 31A of the cover 30 is bent downward in the predetermined width in the forward and backward direction thereof at a small angle at the front end of the flat plate portion 31 of the vessel 21. Although one of them is shown in FIG. 2, support projections 32 are projected downward from the right and left sides in the width direction of the cover 30 substantially at the center of in the forward and backward directions of the cover 30, and a support pin 33 is projected from the outside of the extreme end of each of the support projections 32. Further, the width of the cover 30, at least on the side thereof which is in front of the support pins 33, is narrower than the lateral distance between the inner wall surfaces of the right and left side plates 21A, 21A of the vessel 21, so that the cover 30 can be inserted into the vessel.

Guides 34, 34, each having a C-shaped cross section (viewable in FIG. 1) are attached to the upper surface of the right and left sides of a cover 30 on the front portion thereof, and extend from the support projections 32 with the open sides of the guides 34, 34 facing each other (the open sides face to the insides in the width direction). These guides 34, 34 can be moved in the width direction of the cover 30 and the movement of these guides 34, 34 is interlocked through a not shown interlock mechanism; thus, they are always located symmetrically with respect to the center in the width direction of the cover 30.

The cover 30 is mounted to the recording paper cassette 20 by the support pins 33 engaged with the support grooves 21E defined on the inner walls of the side plates 21B of the vessel 21. Each of the support pins 33 is inserted into a support groove 21E at an upper open edge formed in the side plate 21B, and is moved along and positioned at the front end of the support groove 21E. At this time, as shown in FIG. 2, the rear end of the cover 30 coincides with the rear end of the vessel 21, and the front end 31A of the cover 30 is adjacent to the rear end side of the recording paper upper surface press unit 22A; thus the upper opening of the vessel 21 is covered with cover 30.

An operation is performed, when a recording paper is inserted, by the recording paper cassette 20 provided with the cover 30 with the manual insertion mechanism arranged as described above, and the operation will be described below.

As shown in FIG. 2, when the recording paper cassette 20 is inserted into the cassette inserting portion 11 of the paper supply unit 10 of the imaging apparatus, the front end upper surface of the recording papers 40 is urged toward the recording paper introduction roller 12 by the urging force of the springs 27, 27. Thus, the recording papers 40 are accommodated in the recording paper cassette 20, and can be fed by the rotation of the recording paper and fed roller 12 (introduced into the imaging apparatus). This is a usual state in which the recording papers 40 are supplied from the cassette 20.

Figure 3:
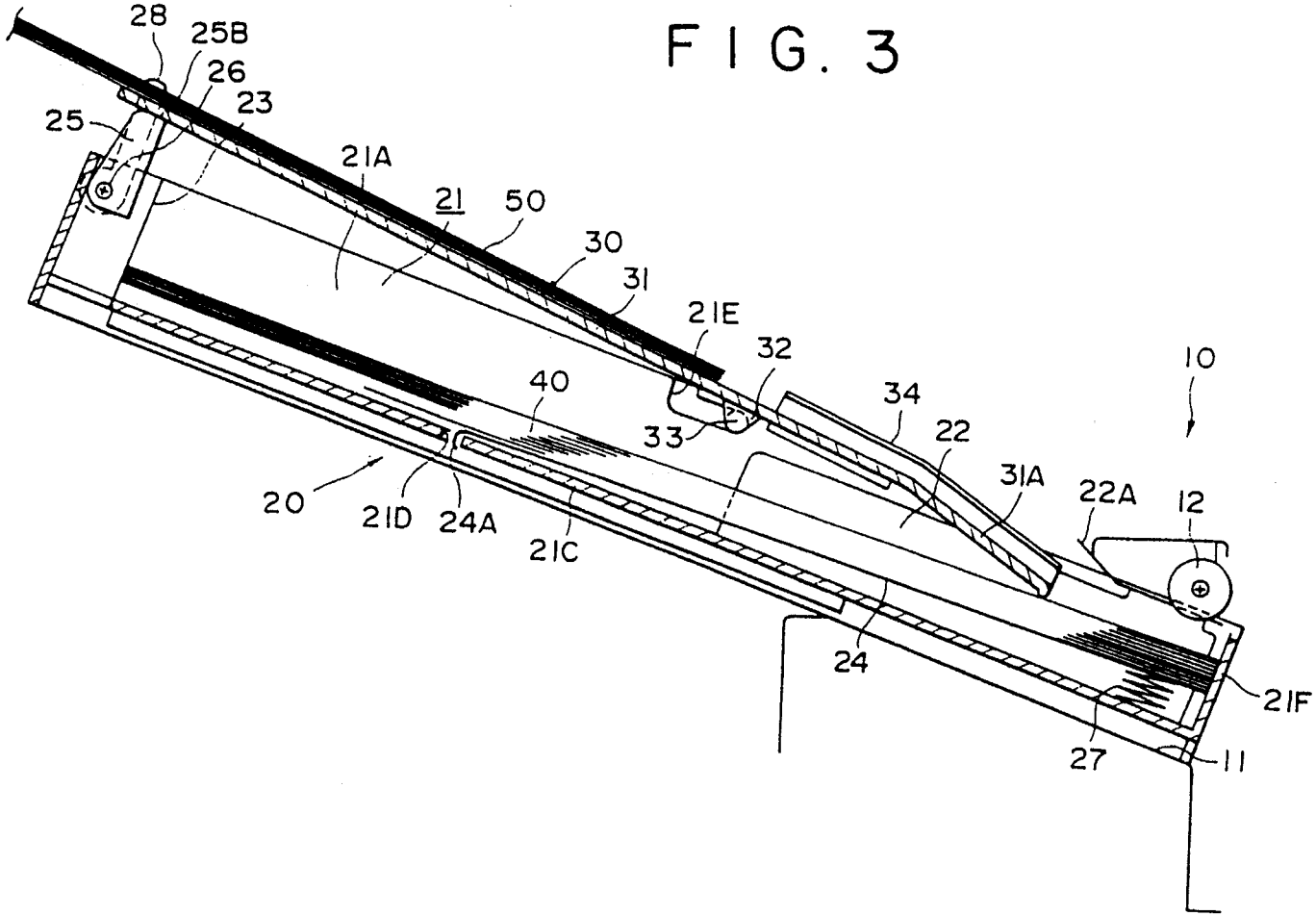
FIG. 3 is a view of the recording paper cassette operated from the state shown in FIG. 2 for manual insertion.

When the lever 25 is swung from a usual (i.e., default) state counterclockwise by 90° from the position indicated in FIG. 2 by the operation lever 28, the extreme end of the lever 25 pushes the rear end side of the cover upward with the manual insertion mechanism 30, by which the cover 30 is swung clockwise about the fulcrum pins 33. Thus the front end 31A of the cover with the manual insertion mechanism 30 is abutted against the upper surface of the recording papers 40 accommodated in the vessel 21 of the recording paper cassette 20, and pushes the recording papers 40 (the recording paper holding plate 24) against the urging force of the springs 27. The upper surface of the recording papers 40 is accordingly separated from the circumference of the recording paper introduction roller 12, as shown in FIG. 3. At this time, the lever 25 is abutted against the lower surface of the cover with the manual insertion mechanism 30 at the entire front end surface thereof and supports the cover 30. As a result, the lever 25 stands vertically with respect to the vessel and is stabilized thus the position of lever 25 cannot be upset naturally.

Figure 4:
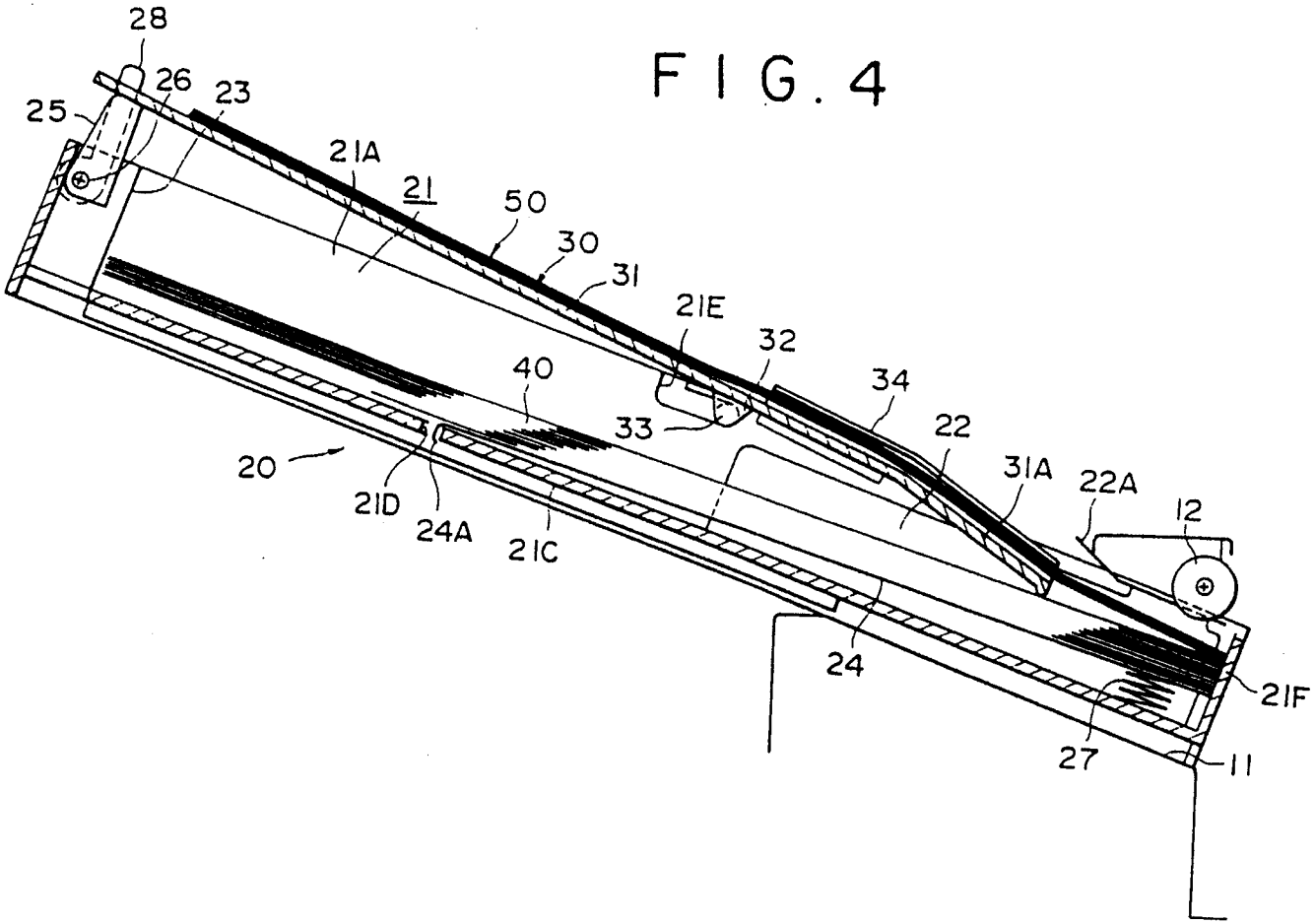
FIG. 4 is a view showing a recording paper to be manually inserted and set in the recording paper cassette shown in FIG. 3.
Figure 5:
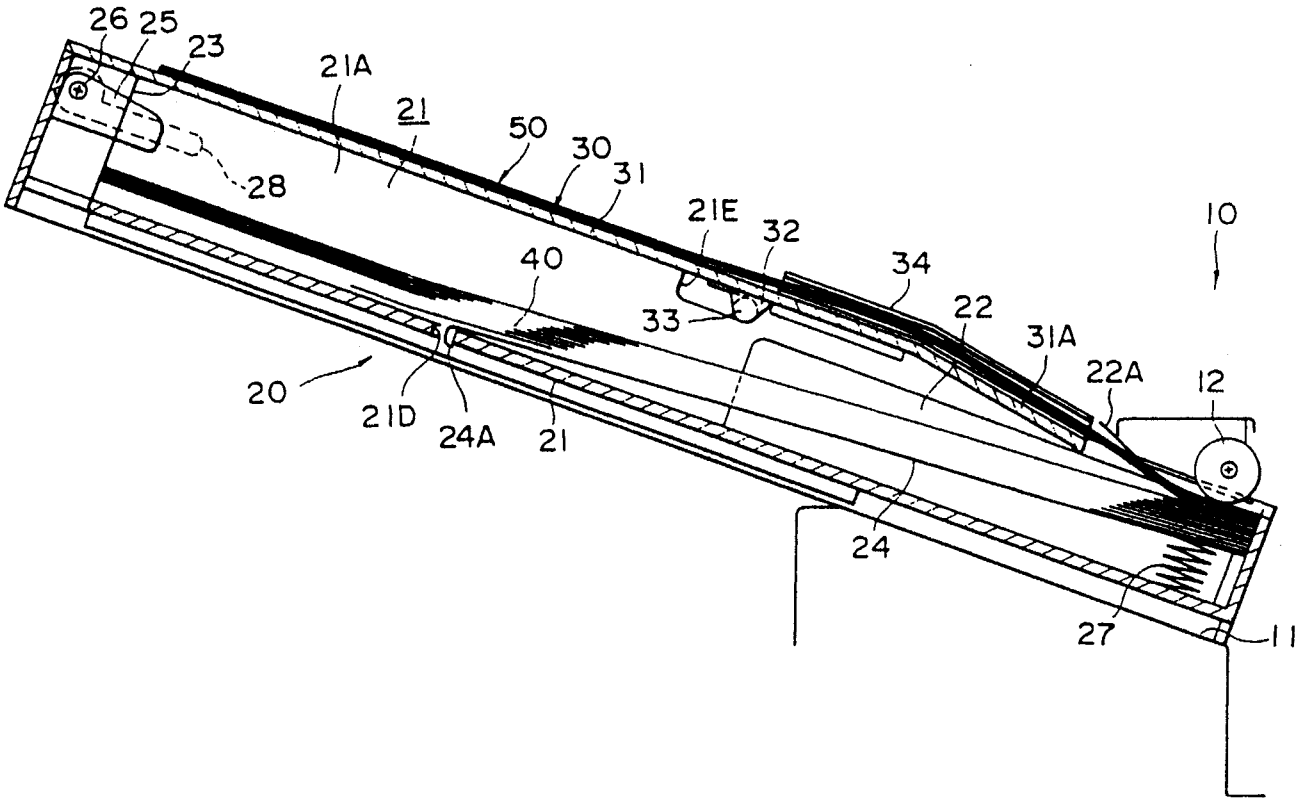
FIG. 5 is a view showing a manually inserted recording paper.

As shown in FIG. 4, a recording paper 50 is manually inserted until the front end thereof abuts against the inner wall surface of the front plate 21F of the vessel 21 in such a manner that the recording paper 50 is caused to slide on the upper surface of the cover (which has the manual insertion mechanism 30) and the opposing side edges thereof are guided by the guides 34, 34. When the rear end of the cover 30 is released from the upwardly biased state by moving the lever 25 in the clockwise direction from the position depicted in FIG. 4 by the operation lever 28, the front end of the recording papers 40 accommodated in the recording paper cassette 20 is swung toward the recording paper introduction roller 12 by the urging force of the springs 27. Thus, as shown in FIG. 5, the manually inserted recording paper 50 is held between the upper surface of the recording papers 40 accommodated in the recording paper cassette 20 and the recording paper introduction roller 12. With this arrangement, the manually inserted upper surface of the recording paper 50 is urged toward the recording paper introduction roller 12 by the urging force of the springs 27, and the manually inserted recording paper 50 is fed by the rotation of the recording paper introduction roller 12 instead of the recording paper 40 accommodated in the recording paper cassette 20.

The present disclosure relates to the subject matter contained in Japanese Patent Application No. HEI 3-261484 filed on Jul. 5, 1991, the content of which is expressly incorporated herein by reference in its entirety.

What is claimed is:

1. A paper cassette which is detachably attached to a printer, said printer including a feed member for individually feeding paper, said cassette comprising:

a cassette body having side walls;

a tray member provided in said cassette body, for receiving a plurality of papers in a stacked state, said feed member being disposed above one end of said tray member for individually feeding the paper stacked on said tray member in a predetermined direction;

a lift member disposed on a bottom surface of said cassette body below said one end of said tray member for urging said one end toward said feed member, thereby causing said stacked papers to be pressed against said feed member;

a guide member disposed above said tray member having one end adjacent to said feed member, said one end of said guide member being swingable towards said one end of said tray member, said guide member being swingably supported by said side walls of said cassette body; and means for swinging one end of said tray member away from said feed member when said one end of said guide member is swung towards said one end of said tray member in such a fashion that a spacing is provided between said feed member and the plurality of stacked papers, which allows other papers, distinct from the stacked papers, to be placed in said spacing and to be fed by said feed member, a top surface of said guide member comprising means for supporting the other papers to be fed by said feed member.

2. The paper cassette according to claim 1, comprising means for supporting a center portion, with respect to the longitudinal direction, of said guide member, so as to be swingable about said center portion.

3. The paper cassette according to claim 2, said cassette further comprising an operation arm fixed to a shaft member rotatably supported by said side walls of said cassette body, the other end of said guide member being moved vertically by manually operating said operation arm.

4. The paper cassette according to claim 1, wherein said guide member is formed to cover substantially the entire area of an upper opening of said cassette body.

5. The paper cassette according to claim 1, further comprising means for removably supporting said guide member for swinging movement by said cassette body.

6. The paper cassette according to claim 1, said guide member comprising at least one guide element movable in a direction substantially transverse to the predetermined feeding direction of the paper stacked in said tray member.

7. A paper cassette adapted to be detachably mounted to a main apparatus for individually supplying stacked papers from said cassette to said main apparatus, said paper cassette comprising:

a cassette body having a base and side walls;

a tray member arranged on said cassette body for stacking a plurality of papers thereon, said tray member having one end which is pivotable toward said cassette base and another free end;

a lift member disposed between said one end and said cassette base for upwardly urging said one end;

a regulating member for regulating the position of an upper surface of said stacked papers;

a guide member arranged above said tray member and supported by said cassette body, one end of said guide member corresponding to said one end of said tray member being swingable toward said tray member, said guide member being swingably supported by said side walls of said cassette body; and means for downwardly swinging said one end of said tray member when said one end of said guide member is swung, to form a space between said stacked papers and said regulating member for allowing other papers, distinct from said stacked papers, to be placed in the space to be fed, a top surface of said guide member comprising means for supporting the other papers to be fed by a feed member of the main apparatus.

8. The paper cassette according to claim 7, wherein said lift member comprises a pair of spring members mounted to said cassette base, said spring members being spaced apart from each other along a direction traversing a paper supply direction.

9. The paper cassette according to claim 7, wherein said regulating member comprises a pair of spaced apart leaf plates formed on said cassette body.

10. The paper feed mechanism according to claim 7, wherein said guide member is supported at a center portion, with respect to the longitudinal direction thereof, so as to be swingable about said center portion.

11. The paper feed mechanism according to claim 7, wherein said guide member is formed to cover substantially the entire area of an upper opening of said cassette body.

12. The paper cassette according to claim 7, further comprising means for removably supporting said guide member for swinging movement by said cassette body.

13. The paper cassette according to claim 7, said guide member comprising at least one guide element movable in a direction substantially transverse to a feeding direction of said stacked paper.

14. A paper feed mechanism comprising:

a paper cassette;

a tray member supported within said cassette for holding a stacked plurality of sheets of paper;

a feed member disposed above one end of said tray member for individually feeding said stacked papers in a predetermined direction, said feed member comprising a contact surface for contacting an upper sheet of said stacked papers;

a lift member disposed below said one end of said tray member for biasing said one end of said tray member toward said feed member, thereby causing said stacked papers to be pressed between said one end of said tray member and said contact surface of said feed member;

a guide member supported by said paper cassette, for receiving and guiding one or more additional sheets of paper toward said contact surface of said feed member, said guide member comprising a generally planar support surface upon which said one or more additional sheets of paper may be placed, said guide member being disposed above said tray member and having one end adjacent to said feed member, said one end of said guide member being swingable towards said one end of said tray member; and means for swinging said one end of said tray member away from said feed member by swinging said one end of said guide member towards said one end of the tray member in such a fashion that a space is provided between said contact surface of said feed member and the stacked papers, to permit the additional papers, distinct from said stacked papers, to be placed in said space and to be fed by said feed member, said generally planar support surface having means for supporting the additional papers to be fed by said feed member.

15. The paper feed mechanism according to claim 14, further comprising means in said paper cassette, for supporting said swinging means for swinging movement.

16. The paper feed mechanism according to claim 13, said swinging means engaging said guide member adjacent an end of said guide member opposite said one end of said guide member.

17. The paper feed mechanism according to claim 14, said guide member comprising means for covering substantially an entire area of an upper portion of said paper cassette.

18. The paper feed mechanism according to claim 14, further comprising means for supporting said guide member at a center portion of said guide member for swinging movement about said center portion.

19. The paper feed mechanism according to claim 14, further comprising means for swingably supporting said guide member in opposite side walls of said paper cassette.

20. The paper feed mechanism according to claim 14, further comprising an operation arm fixed to a shaft member, and means for supporting said shaft member in opposite side walls of said paper cassette, said operation arm being operably coupled to said swinging means.

21. The paper feed mechanism according to claim 14, further comprising regulating means for regulating the position of an upper surface of a topmost sheet of said stacked sheets of paper.

22. The paper feed mechanism according to claim 14, further comprising means for removable supporting said guide member for swinging movement by said paper cassette.

23. The paper feed mechanism according to claim 14, said guide member comprising at least one guide element movable in a direction substantially transverse to a feeding direction of said stacked papers.

* * * * *

UNITED STATES PATENT AND TRADEMARK OFFICE

CERTIFICATE OF CORRECTION

PATENT NO. : 5,346,197
DATED : SEPTEMBER 13, 1994
INVENTOR(S) : Masatoshi TAKANO et al.

It is certified that error appears in the above-indentified patent and that said Letters Patent is hereby corrected as shown below:

At column 8, line 46 (claim 16, line 1), change "13" to --14---.

Signed and Sealed this

Fourth Day of July, 1995

Bruce Lehman

*Attest:*

BRUCE LEHMAN

*Attesting Officer*

*Commissioner of Patents and Trademarks*